United States Patent [19]

Phillips

[11] 3,964,267

[45] June 22, 1976

[54] REFRIGERATION CHARGING CYLINDER

[76] Inventor: Clyde G. Phillips, R.R. No. 2, Box 148-G, Angola Beach, Lewes, Del. 19958

[22] Filed: Mar. 14, 1975

[21] Appl. No.: 558,305

[52] U.S. Cl. ..... 62/51; 62/292; 222/4

[51] Int. Cl.[2] ..... F17C 7/02

[58] Field of Search ..... 62/45, 50, 51, 52, 77, 62/292; 222/4, 402.18

[56] References Cited

UNITED STATES PATENTS

| | | | |
|---|---|---|---|
| 1,744,287 | 1/1930 | Tibbetts | 62/292 |
| 1,977,267 | 10/1934 | Endacott | 62/50 |
| 3,021,870 | 2/1962 | Allen | 222/4 X |
| 3,258,160 | 6/1966 | Allen | 222/4 |

*Primary Examiner*—William F. O'Dea
*Assistant Examiner*—Ronald C. Capossela
*Attorney, Agent, or Firm*—Clarence A. O'Brien; Harvey B. Jacobson

[57] ABSTRACT

A refrigerant charging cylinder for vapor refrigeration systems has a valve mounted on a refrigerant tank in which a refrigerant is partially liquid and partially gaseous, with the tank being arranged during use thereof with the gas between the liquid and the valve. Included in the valve is a saturated vapor pipe which extends into and terminates above a maximum level of liquid refrigerant in the tank, while a liquid refrigerant pipe mounted within the saturated vapor tube extends into the liquid refrigerant. By this arrangement, a flow of gaseous refrigerant through the saturated vapor tube will draw liquid refrigerant through the liquid refrigerant pipe, mix the liquid refrigerant with the gaseous refrigerant, and form a vapor that can be fed to the suction side of the compressor of a vapor-compression refrigeration system while the compressor is operating.

8 Claims, 3 Drawing Figures

REFRIGERATION CHARGING CYLINDER

BACKGROUND OF THE INVENTION

1. Field of the Invention

This invention relates generally to the charging of refrigeration systems, and particularly to a refrigerant charging cylinder for use with conventional refrigeration systems.

2. Description of the Prior Art

The recharging of refrigeration systems in the conventional manner employed today is very time consuming and difficult, and can be extremely dangerous. The cylinders used today will emit either refrigerant gas or refrigerant liquid, but will not emit anything in-between these two states. To carry out the conventional recharging procedure, the refrigerant cylinder is inserted into the high side of the refrigeration system with the compressor stopped. See U.S. Pat. No. 3,118,288, issued Jan. 21, 1964 to P. J. Small. Further, the refrigerant cylinder must be inverted so that the liquid refrigerant will be next to the outlet valve conventionally provided on such cylinders. When the pressure in the refrigeration system is equal to the pressure in the cylinder, the cylinder is turned right side up, connected to the suction side of the compressor of the refrigeration system, and a charge of gas drawn into the system while the compressor is running. Soon, however, the refrigerant cylinder becomes very cold as the liquid in the cylinder boils to give up gas to the top of the cylinder. Thus, the cylinder becomes very cold, and it may become necessary to pour hot water, and the like, on the cylinder in order to continue working with same. Some technicians even become so desperate as to light a torch and heat the tank portion of the cylinder in order to keep the outer surface of the tank at tolerable levels, which heating is, of course, against pertinent safety laws.

U.S. Pat. No. 3,785,163, issued Jan. 15, 1974 to W. Wagner, discloses a refrigerant charging tool and method of using same which is intended to simplify the charging of refrigeration systems. This tool, however, requires the use of an expensive and heavy charging manifold which converts liquid refrigerant into a saturated vapor which may be fed to the low, or suction, side of the refrigeration system while the compressor of the system is running. Thus, while the charging manifold of Patent No. 3,785,163 eliminates the need for carrying out a two-stage charging process by converting liquid refrigerant into a saturated vapor which is injectable into the suction side of a compressor, the refrigerant cylinder must still be inverted in order to provide liquid refrigerant to the expensive and complicated charging manifold.

It is very dangerous to invert refrigerant cylinders of the, for example, 25 pound size and up, since the relief valve on the conventional cylinders of, for example, 25 pounds, 30 pounds, and 50 pounds is built into the outlet valve arranged at the top of the tank. If a service technician should shut off the valve on a conventional refrigerant cylinder while the cylinder is in an inverted position so as to temporarily leave the charging equipment, and the charging cylinder, which may be a 30 pound tank of Refrigerant 12, and the like, is exposed to the sun, a radiator, or other source of heat, the cylinder may overheat with resulting heating of the refrigerant and possible rupture of the relief valve. With the cylinder in an inverted position, the thrust will be upward through the ruptured relief valve and the cylinder would become airborne.

Another disadvantage of the charging tool set forth in U.S. Pat. No. 3,785,163 is that a single device will not cover an entire range of standardsize refrigerant cylinders. Thus, the investment in these devices becomes greater since a set of, for example, three such charging tools must be available in order to permit one to charge a refrigeration system from any of the standard size refrigerant cylinders.

Further, the conventional refrigerant cylinders are inherently unstable and difficult to work with when they are in an inverted position. If, for example, the hose connecting the outlet valve of the cylinder to the refrigeration system comes loose from the outlet valve of the cylinder, or perhaps is knocked loose by a workman bending over trying to manipulate the outlet valve, a costly delay and possible injury to personnel may result.

Another problem in the conventional technique for recharging refrigeration systems is that it is economically unfeasible to refill the standard refrigerant cylinders of the 50 pound size and smaller. The result is that these smaller cylinders are presently being thrown away or sold as surplus, with the result that they are subject to misuse by irresponsible and uninformed parties.

It is known generally to provide valve systems which dispense vapor from a pressure vessel containing liquefied gas and vapor under pressure. Examples of such valves are shown in U.S. Pat. Nos. 2,991,918, issued July 11, 1961, and 3,258,168, issued June 28, 1966, both to G. R. Allen. U.S. Pat. No. 1,938,036, issued Dec. 5, 1933 to T. C. Martin et al, also discloses a dispensing valve which will vaporize a liquid drawn from an associated tank.

SUMMARY OF THE INVENTION

It is an object of the present invention to provide a vaporizing valve for discharging refrigerant from a refrigerant cylinder.

It is another object of the present invention to provide a refrigerant cylinder which will discharge vaporized refrigerant when the cylinder is in its normal, upright position resting on the base of the cylinder.

It is still another object of the present invention to provide a vaporizing valve for refrigerant tanks that will make it feasible to recharge the smaller size refrigerant cylinders presently being thrown away.

These and other objects are achieved according to the present invention by providing a refrigerant charging cylinder having: a tank containing a partially liquid and partially gaseous refrigerant and having an opening arranged spaced from a maximum liquid level of the refrigerant when the tank is in an upright position; a valve mounted on the tank and arranged in the tank opening, the valve including a housing, an inlet port and an outlet port provided in the housing, a valve element disposed in the housing between the inlet port and the outlet port for selectively blocking and unblocking passage between the ports, and a saturated vapor pipe connected to the housing so as to surround the inlet port and arranged extending into the tank through the tank opening, the saturated vapor pipe terminating in the tank short of a maximum level of liquid refrigerant in the tank; and a liquid refrigerant pipe arranged in the saturated vapor pipe and extending into the liquid refrigerant in the tank, the liquid refrigerant being carried through the liquid refrigerant pipe by the suction effect created by the flow of gaseous refrigerant through the saturated vapor pipe and mixed with the gaseous refrigerant to form a vapor.

The liquid refrigerant pipe advantageously includes a straight portion attached to the saturated vapor pipe and extending from the latter into the tank, and an offset portion disposed in the center of the saturated vapor pipe. A fluid nozzle preferably terminates the offset portion of the liquid refrigerant pipe for assuring an optimum pull on the liquid refrigerant up through the liquid refrigerant pipe and facilitating atomization of the liquid refrigerant as the latter mixes with the gaseous refrigerant flowing through the saturated vapor pipe.

The refrigerant cylinder valve according to the present invention preferably further includes an outlet pipe connected to a housing of the valve and surrounding an outlet port provided in the housing, with the outlet pipe being connected to the suction side of the compressor of a conventional vapor-compression refrigeration system, and the like.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
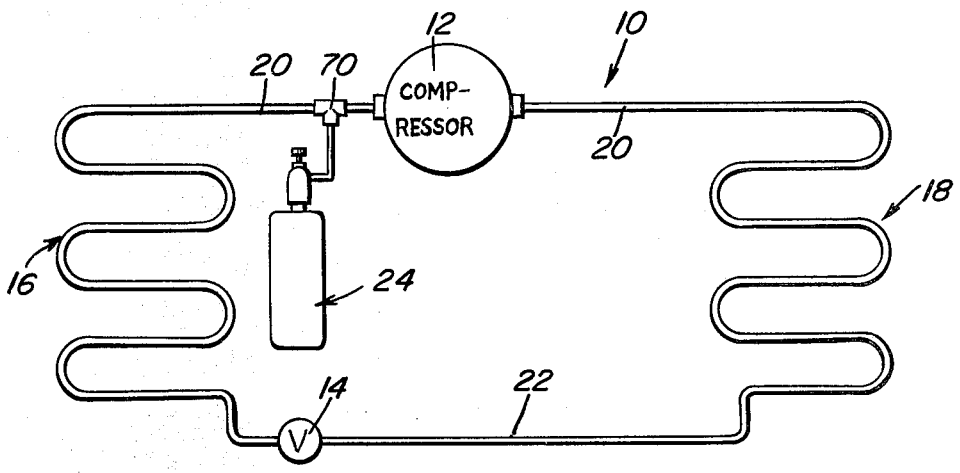
FIG. 1 is a schematic diagram showing a refrigeration system charging arrangement according to the present invention.

Referring now more particularly to FIG. 1 of the drawings, a vapor refrigeration system 10 including, in the conventional manner, a compressor 12, an expansion valve 14, an evaporator 16, a condenser 18, and a pair of lines 20 and 22 connecting together evaporator 16 and condenser 18, with compressor 12 inserted in line 20 and expansion valve 14 inserted in line 22, has a refrigerant charging cylinder 24 according to the present invention inserted in line 20 between evaporator 16 and compressor 12. By the novel construction of charging cylinder 24, which will be described below, saturated refrigerant vapor is emitted from charging cylinder 24 and passed to compressor 12 while the compressor, and thus system 10, is operating. Further, since charging cylinder 24 will emit saturated refrigerant vapor while cylinder 24 is in an upright position, it will be appreciated that system 10 can be charged in a simple, safe, and efficient manner.

Figure 2:
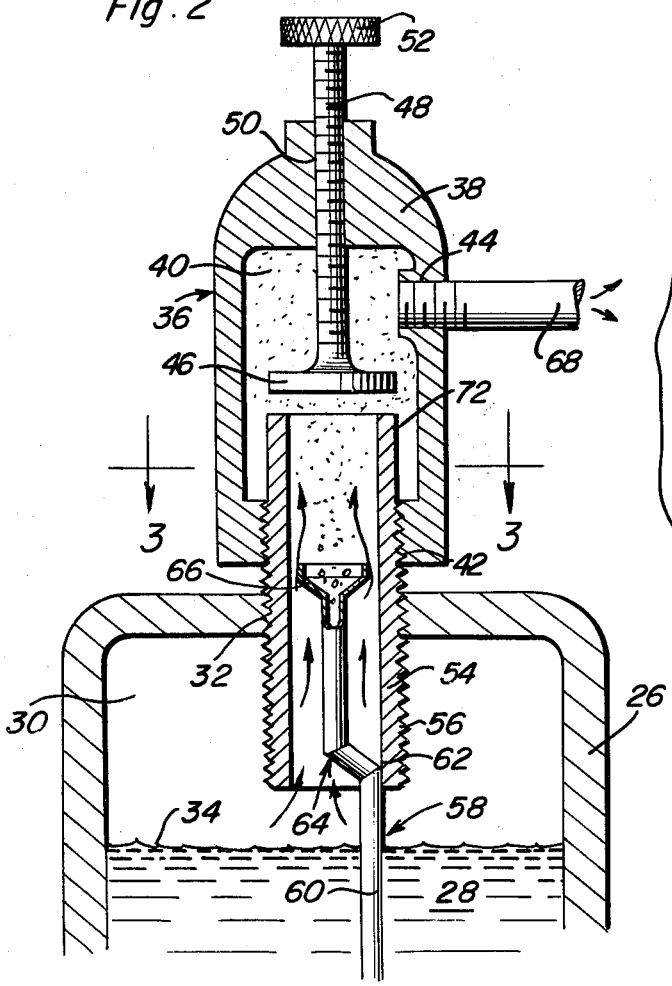
FIG. 2 is a fragmentary, vertical sectional view showing the upper portion of a refrigerant cylinder according to the present invention.
Figure 3:
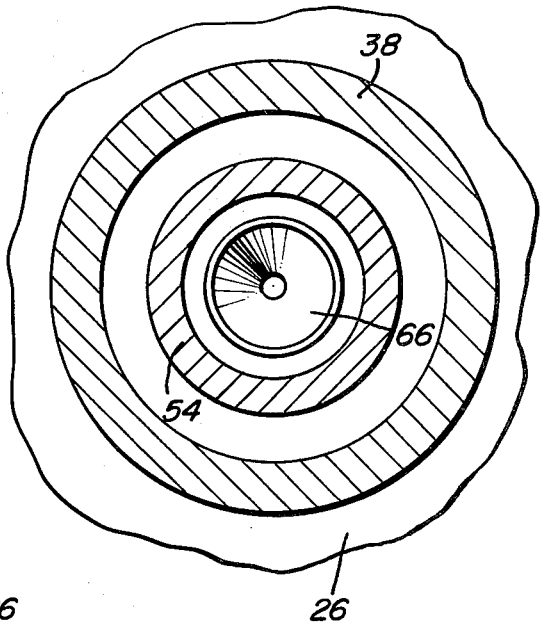
FIG. 3 is a fragmentary, sectional view taken generally along the line 3—3 of FIG. 2.

Referring now to FIGS. 2 and 3 of the drawings, charging cylinder 24 includes a tank 26 formed and constructed in a manner as conventionally used for constructing refrigerant cylinders. This tank 26 advantageously contains a refrigerant which is partially liquid 28 and partially gas 30 and is provided with an opening 32, which advantageously has the illustrated internal screw threads, arranged spaced from a maximum liquid level 34 of the refrigerant when tank 26 is in its normal upright position. The latter position is that illustrated in FIGS. 1 and 2 of the drawings.

A valve 36 is mounted on tank 26 at the upper end thereof and is arranged in the opening 34 provided in tank 26 at the upper end thereof. This valve 36 includes a housing 38 provided with an internal cavity 40, a preferably threaded inlet port 42 and an also preferably threaded outlet port 44 provided in housing 38 in communication with cavity 40, a valve element 46 disposed within cavity 40 of housing 38 between inlet port 42 and outlet port 44 for selectively blocking and unblocking passage between ports 42 and 44, with a threaded rod 48 being threadingly arranged in a threaded bore 50 provided in housing 38 so as to communicate with cavity 40 and having a knob 52 affixed to the end of rod 48 outside of housing 38 for permitting manipulation of valve element 46 in a known manner, and a saturated vapor pipe 54 arranged surrounding inlet port 42 and extending into the interior of tank 26 through the opening 34 provided in the tank. Saturated vapor pipe 54 terminates within tank 26 short of the maximum level 32 of liquid 28 in tank 26, as can be readily seen from FIG. 2. Preferably, but not necessarily, threads 56 may be provided on the outer surface of pipe 54 for cooperating with the internal threads provided in opening 34 and facilitating mounting of valve 36 on the tank 26.

A liquid refrigerant pipe 58 is arranged in saturated vapor pipe 54 and extends into the liquid 28 in tank 26. By this arrangement, an ejector is formed wherein the flow of gas 30 through saturated vapor pipe 54 whenever valve element 46 is in a position, as shown in FIG. 2, where the passage between inlet port 42 and outlet port 44 is unblocked, creates a suction effect which draws liquid 28 through liquid refrigerant pipe 58 and into saturated vapor pipe 54 where the liquid 28 is mixed with gas 30 to form a saturated vapor of the refrigerant.

Liquid refrigerant pipe 58 advantageously includes a straight portion 60 attached to an inner wall of saturated vapor pipe 54 at a lower end of pipe 54 in a conventional manner, such as by weld 62, and the like, and extends from pipe 54 into the interior of tank 26 so as to penetrate liquid 28 during the normal range of levels of liquid 28 within tank 26 during the life of the charge of refrigerant within the cylinder 24. Refrigerant pipe 58 also includes an offset portion 64 which provides a transition from the inner wall of pipe 54 to the center of the latter and terminates in, for example, the illustrated fluid nozzle 66, which may have, for example, a 45 degree flare from the associated pipe for creating a maximum draw on liquid 28 through pipe 58. The ratio of gas 30 to liquid 28 being drawn through valve 36 may be easily calibrated by the size, and the angle, of flared nozzle 66 which terminates pipe 58 within pipe 54.

Valve 36 further includes an outlet pipe 68 connected to housing 38 so as to surround outlet port 44 and connected to line 20 as by a conventional key 70 (FIG. 1). Further, as can be readily seen from FIG. 2 of the drawing, valve element 46 is preferably arranged blocking and unblocking inlet port 42 by seating against the end 72 of saturated vapor pipe 54 arranged within cavity 40 of housing 38.

While the illustrated flared nozzle 66 is preferred, it will be appreciated that other arrangements for the outlet end of liquid refrigerant pipe 58 may be employed if desired. For example, the offset portion of pipe 58 may extend completely across pipe 54 so as to have the outlet of pipe 58 adjacent the inner wall of pipe 54 at a point opposed to the attachment of the straight portion of pipe 58 to the inner wall of pipe 54. Further, the straight portion of the liquid refrigerant pipe may extend up to the outer wall of the saturated vapor pipe, pass through an aperture provided in the wall of the saturated vapor pipe and into the interior of the latter. The illustrated flared nozzle 66, however, effectively forms a throat within saturated vapor pipe 54 that effectively enhances the desired suction effect on the liquid being drawn through the liquid refrigerant pipe 58.

As will be appreciated from the above description and from the drawings, charging cylinder 24 forms a simple, reliable, and reusable device which makes possible the recharging of refrigeration systems in a simple and safe manner. By proper design, the liquid refrigerant pipe can be made small enough so that there will never be enough liquid in the vapor to harm any compressor with which the cylinder 24 may be employed. Further, valve 36 is self-calibrating in that when the valve is first opened by turning knob 52, although it should be understood another form of handle could be used, the gas 30 leaves tank 26 at a high velocity drawing liquid 30 up pipe 58 also at a high velocity and both are mixed at a high velocity. As tank 26 becomes cooler, the velocity of gas 30 and liquid 28 increase together so that the ratio between the two velocities remains substantially constant.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A refrigerant charging cylinder for refrigeration systems, comprising, in combination:

means for drawing liquid refrigerant from the cylinder effected by the flow of saturated vapor flowing from the cylinder comprising;

a. a tank containing a partially liquid and partially gaseous refrigerant and having an opening arranged spaced from a maximum liquid level of the refrigerant when the tank is arranged for charging a refrigeration system;

b. a valve mounted on the tank and arranged partially in the tank opening, the valve including a housing an inlet port and an outlet port provided in the housing, a valve element disposed in the housing between the inlet port and the outlet port for selectively blocking and unblocking passage between the ports, and a saturated vapor pipe connected to the housing and surrounding the inlet port and arranged extending into the tank through the tank opening, the saturated vapor pipe terminating in the tank short of a maximum level of liquid refrigerant in the tank; and c. a liquid refrigerant pipe having a fluid nozzle thereon arranged in the saturated vapor pipe and extending into the liquid refrigerant in the tank, the liquid refrigerant being carried through the liquid refrigerant vapor pipe by a flow of gaseous refrigerant through the saturated vapor pipe and mixed with the gaseous refrigerant to form a saturated vapor.

2. A structure as defined in claim 1, wherein the valve further includes an outlet pipe connected to the housing and surrounding the outlet port, with the valve element being arranged to selectively block and unblock the inlet port.

3. A refrigerant charging cylinder for refrigeration systems, comprising, in combination:

a. a tank containing a partially liquid and partially gaseous refrigerant and having an opening arranged spaced from a maximum liquid level of the refrigerant when the tank is arranged for charging a refrigeration system;

b. a valve mounted on the tank and arranged partially in the tank opening, the valve including a housing, an inlet port and an outlet port provided in the housing, a valve element disposed in the housing between the inlet port and the outlet port for selectively blocking and unblocking passage between the ports, and a saturated vapor pipe connected to the housing and surrounding the inlet port and arranged extending into the tank through the tank opening, the saturated vapor pipe terminating in the tank short of a maximum level of liquid refrigerant in the tank; and c. a liquid refrigerant pipe arranged in the saturated vapor pipe and extending into the liquid refrigerant in the tank, the liquid refrigerant being carried through the liquid refrigerant vapor pipe by a flow of gaseous refrigerant through the saturated vapor pipe and mixed with the gaseous refrigerant to form a saturated vapor, and the liquid refrigerant pipe includes a straight portion attached to the saturated vapor pipe and extending from the latter into the tank, and an offset portion forming a transition from the straight portion to a center of the saturated vapor pipe, and forming a throat within the saturated vapor for increasing the suction on the liquid being drawn through the liquid refrigerant pipe by the flow of gas through the saturated vapor pipe.

4. A structure as defined in claim 3, wherein the valve further includes an outlet pipe connected to the housing and surrounding the outlet port, with the valve element being arranged to selectively block and unblock the inlet port.

5. In combination with a vapor refrigeration system including a compressor, an expansion valve, a condenser, and an evaporator, a pair of lines connecting together the condenser and evaporator, the compressor inserted in one of the lines and the expansion valve in the other of the lines; a refrigerant charging cylinder inserted between the evaporator and the compressor for charging saturated vapor to the compressor while the system is operating, the charging cylinder comprising, in combination:

means for drawing liquid refrigerant from the cylinder effected by the flow of saturated vapor flowing from the cylinder comprising;

a. a tank containing a partially liquid and partially gaseous refrigerant and having an opening arranged spaced from a maximum liquid level of the refrigerant when the tank is arranged for charging a refrigeration system;

b. a valve mounted on the tank and arranged partially in the tank opening, the valve including a housing, an inlet port and an outlet port provided in the housing, a valve element disposed in the housing between the inlet port and the outlet port for selectively blocking and unblocking passage between the ports, and a saturated vapor pipe connected to the housing and surrounding the inlet port and arranged extending into the tank through the tank opening, the saturated vapor pipe terminating in the tank short of a maximum level of liquid refrigerant in the tank; and c. a liquid refrigerant atomizer ejector pipe arranged in the saturated vapor pipe and extending into the liquid refrigerant in the tank, the liquid refrigerant being carried through the liquid refrigerant vapor pipe by a flow of gaseous refrigerant to form a saturated vapor.

6. A structure as defined in claim 5, wherein the valve further includes an outlet pipe connected to the housing and surrounding the outlet port, with the valve element being arranged to selectively block and unblock the inlet port.

7. In combination with a vapor refrigeration system including a compressor, an expansion valve, a condenser, and an evaporator, a pair of lines connecting together the condenser and evaporator, the compressor inserted in one of the lines and the expansion valve in the other of the lines; a refrigerant charging cylinder inserted between the evaporator and the compressor for charging saturated vapor to the compressor while the system is operating, the charging cylinder comprising, in combination:

a. a tank containing a partially liquid and partially gaseous refrigerant and having an opening arranged spaced from a maximum liquid level of the refrigerant when the tank is arranged for charging a refrigeration system;

b. a valve mounted on the tank and arranged partially in the tank opening, the valve including a housing, an inlet port and an outlet port provided in the housing, a valve element disposed in the housing between the inlet port and the outlet port for selectively blocking and unblocking passage between the ports, and a saturated vapor pipe connected to the housing and surrounding the inlet port and arranged extending into the tank through the tank opening, the saturated vapor pipe terminating in the tank short of a maximum level of liquid refrigerant in the tank; and c. a liquid refrigerant pipe arranged in the saturated vapor pipe and extending into the liquid refrigerant in the tank, the liquid refrigerant being carried through the liquid refrigerant vapor pipe by a flow of gaseous refrigerant to form a saturated vapor, and the liquid refrigerant pipe includes a straight portion attached to the saturated vapor pipe and extending from the latter into the tank, and an offset portion forming a transition from the straight portion to a center of the saturated vapor pipe, and forming a throat within the saturated vapor pipe for increasing the suction on the liquid being drawn through the liquid refrigerant pipe by the flow of gas through the saturated vapor pipe.

8. A structure as defined in claim 7, wherein the valve further includes an outlet pipe connected to the housing and surrounding the outlet port, with the valve element being arranged to selectively block and unblock the inlet port.

* * * * *